United States Patent [19]

Burns

[11] Patent Number: 4,840,299

[45] Date of Patent: Jun. 20, 1989

[54] DISPENSER ADAPTER

[76] Inventor: Jack Burns, 11 N. John St., Pearl River, N.Y. 10965

[21] Appl. No.: 181,414

[22] Filed: Apr. 14, 1988

[51] Int. Cl.[4] ..... B26F 3/02

[52] U.S. Cl. ..... 225/52; 225/84; 225/87; 225/48

[58] Field of Search ..... 225/51, 82, 87, 48, 225/49, 50, 52, 74; 206/395, 409; 83/388, 389

[56] References Cited

U.S. PATENT DOCUMENTS

| | | | |
|---|---|---|---|
| 452,719 | 5/1891 | Ross | 225/82 |
| 1,039,344 | 9/1912 | Wilkinson et al. | 225/47 |
| 2,115,867 | 5/1938 | McConnell | 225/51 X |
| 2,319,071 | 5/1943 | Mason | 225/51 X |
| 3,608,413 | 9/1969 | Borello | 83/142 |

*Primary Examiner*—Frank T. Yost
*Assistant Examiner*—Rinaldi Rada
*Attorney, Agent, or Firm*—James F. Cottone

[57] ABSTRACT

A dispenser adapter to improve the dispensing of thin webs from rolls of material contained in conventional dispensing boxes is specially configured to provide its benefits of antirecoil and risk free tearing to a wide range of dispensing boxes. The adapter is particularly suited to being retrofitted to commercially available dispensing boxes containing a wide range of materials such as plastic wrap, aluminum foil, and wax paper, while allowing the user to dispense these various materials by a single consistent, positively controlled, feeding and tearing action. In a preferred embodiment, a pressure plate loaded by one or more metal springs allows the user to easily exert a proportional braking action, and alternate embodiments teach the use of low cost resilient materials in various arrangements to provide the desired dynamic spring action. Additionally, a complete dispensing unit is disclosed which incorporates the teachings of the improved adapter.

14 Claims, 2 Drawing Sheets

FIG. 1
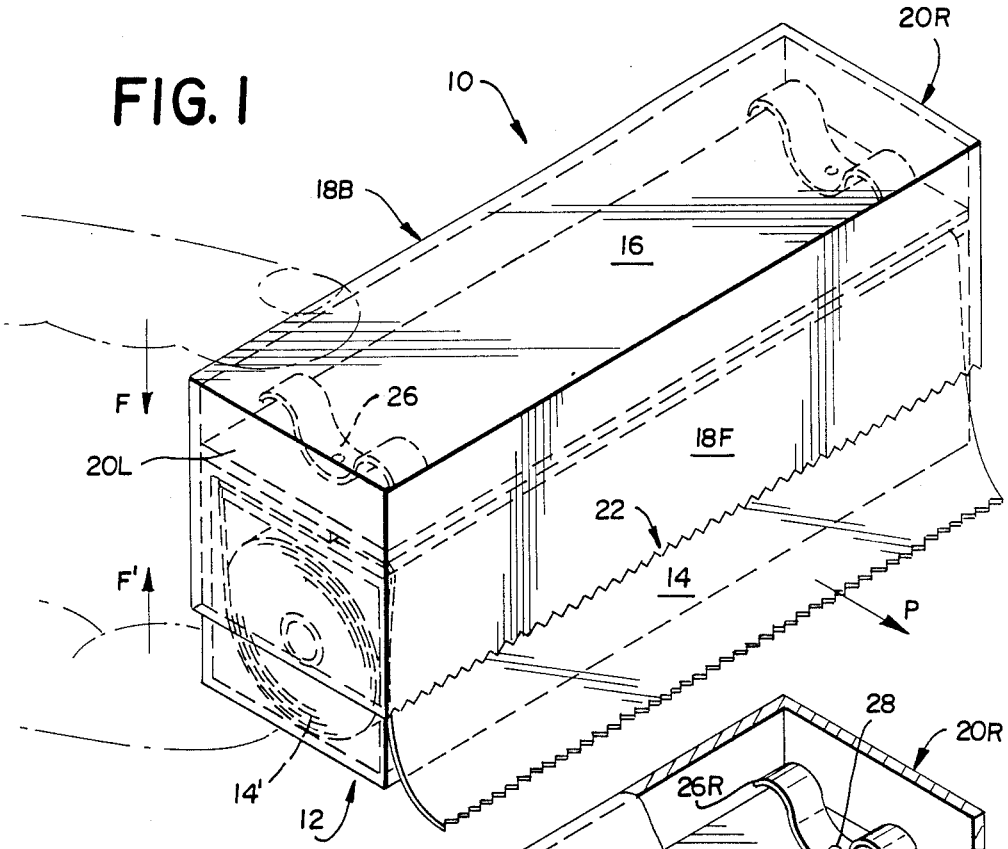
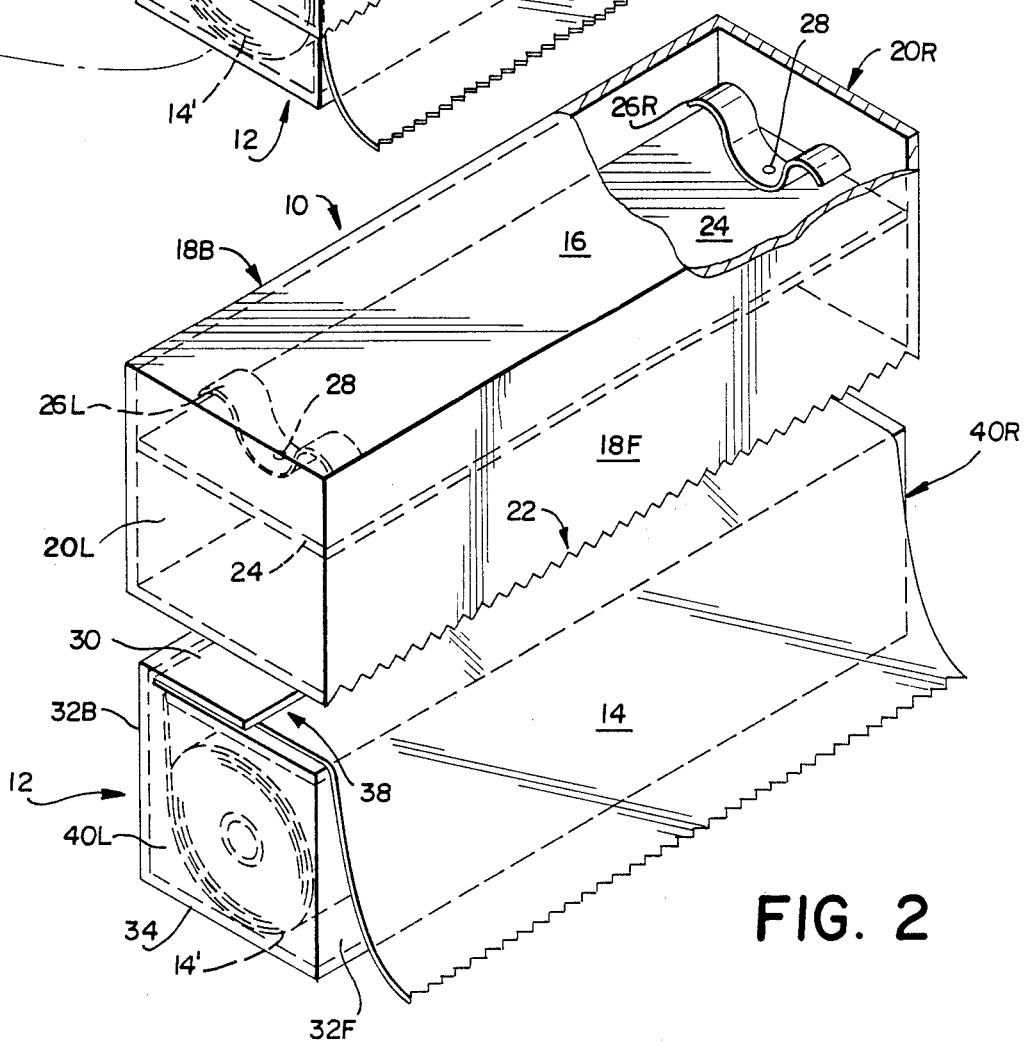
FIG. 2

DISPENSER ADAPTER

BACKGROUND OF THE INVENTION

1. Field of the invention

The present invention relates generally to dispensing of small portions of thin webs from rolls by pulling and tearing, and more specifically to an adapter configured to be fitted onto conventional dispensing boxes to improve their dispensing action.

2. Description of the Prior Art

Devices for the dispensing of small portions of sheet material from rolls of indeterminant length are, of course, well known and have a long history of developement. A significant number of U.S. Patents teach methods and apparatus to accomplish a wide variety of dispensing actions, and are reflective of the amount of effort which have been put into this area over the years. For example, U.S. Pat. No. 2,334,997 to Doll discloses one approach to the dispensing of paper products from a hand held container using a pulling and tearing action, wherein the user by hand pressure may somewhat control the pulling action, and the cutting action is accomplished against a sharp edge located along one extremity of a triangular shaped box.

In another U.S. Pat. No. 2,614,015 to MeGchee there is disclosed a wall mounted box, formed of two parts, which is used to dispense wax paper. A cut-out access hole through both parts is provided to allow the user to insert a finger and coax out the next portion of web to be pulled out and torn off.

Also, Canadian Pat. No. 541,507 to Finkel teaches yet another approach to controlling the pulling/tearing action of a sheet material dispenser. In this patent, we see a steel spring having a plastic/rubber coated end positioned so as to contact the web as it is pulled from between two surfaces forming a container housing the roll of material. The spring loaded coated end is angled so as to exert a type of ratchet action on the web being dispensed to overcome possible roll recoil action.

Due to the increasing availability of, and continuous demand for, disposable household products such as wax paper, plastic wrap, and the like, an entire industry has emerged to produce the containers and dispensers needed to carry these products. Lacking any industry-wide standards, the resulting dispensing boxes of the tear-off type include a bewildering array of approaches to the manipulative tasks which must be mastered to beneficially use the products being dispensed. Many of the existing boxes represent difficult puzzles to the users as they try to operate them; while others pose safety hazards as novice fingers attempt to work in close proximity to the sharp cutting edges which may be positioned in entirely unexpected or out of view places. These puzzles include the steps of; initially opening the dispensing box and removing the first portion of the web; arranging the web ends for property tearing against a possibly as yet unknown tearing edge; and deftly controlling the pulling rate while preventing unwanted recoil after the desired length of web is pulled and torn.

Many of these difficulties are, however, largely the result of a lack of user familiarity with the particular techniques needed to manipulate a particular dispensing box—which technique may not be appropriate to the very next dispensing box which the user is called on to handle. Therefore, it is clear that a need exists for a dispensing aid which will mitigate these difficulties, and which will provide the user with a straight-forward device which allows a single, well known, and well controlled dispensing technique to be applied to the wide range of dispensing boxes in existence. The improved dispenser adapter taught in the present invention admirably meets this need.

SUMMARY OF THE INVENTION

It is therefore a primary object of the present invention to provide an improved dispenser adapter for use with existing dispensing boxes of the pull and tear type; and one which will overcome the disadvantages of the prior art devices.

A further object of the prsent invention is to provide an improved dispenser adapter which may be fitted over existing dispensing boxes and which cooperates with the box structure to provide a single, safe, and controllable pulling/tearing action, thereby greatly aiding in the dispensing of small sections of thin webs.

A yet further object of the present invention is to provide a highly controllable, spring loaded, force producing element within the improved dispenser adapter to allow the user to positively control the friction applied to the web within the dispensing box.

A yet further object of the present invention is to provide this highly controllable force via a range of spring types and configurations, including metal springs and springs implemented using predetermined volumes of resilient materials such as plastic foam, such that the spring's dynamic properties and not merely the manual dexterity of the user exert these controllable forces.

A still further object of the present invention is to provide an improved dispensing unit comprising an improved dispenser adapter of the types recited above in combination with a dispensing box such that a wide range of household or industrial webs may be dispensed using a single and easily mastered dispensing action.

By means of a number of illustrative, preferred, and alternate embodiments, the present disclosure teaches the broad principles of an improved dispensing technique wherein the user can apply easily controllable friction action to the webs being dispensed, and both proportional and on/off braking action is applied to the web via the particular spring structures disclosed. Both metal and resilient material springs are employed, and a wide range of spring distributions are employed to produce a desired array of forces which allow the dispensing action to be accomplished, resulting in a hetertofore unavailable safe and effective dispensing technique.

BRIEF DESCRIPTION OF THE DRAWINGS

Additional objects and advantages of the invention will become apparent to those skilled in the art as the description proceeds with reference to the accompanying drawings wherein:

FIG. 1 is a perspective view of an improved dispenser adapter according to the present invention;

FIG. 2 is a perspective view of the improved dispenser adapter positioned above a conventional dispensing box with which it may be associated;

DETAILED DESCRIPTION OF THE PREFERRED EMBODIMENTS

Figure 3A:
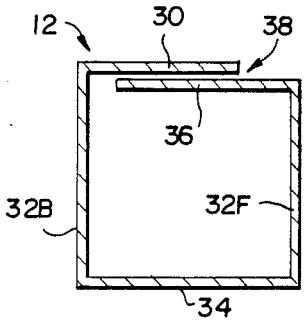
FIG. 3A is a simplified transverse cross sectional view of the conventional dispensing box.

Referring now to FIG. 1, there is shown a perspective view of an illustrative dispenser adapter according to the present invention. The adapter 10 is shown in use as being positioned over a conventional household wrap dispenser box 12, the combination of which greatly facilitates the dispensing of plastic wrap 14. By way of a brief overview, the adapter 10 is formed as a five sided, open bottomed covering device, rectangular in cross section and sized to fit snugly over existing dispenser boxes. In particular, the adapter 10 comprises a top 16, front and back elongated sides 18F and 18B, two end sections 20L and 20R, and may be made from a variety of materials. Illustrative materials include cardboard, plastics, sheet metal, and similar thin sheet materials which are amenable to low cost fabrication techniques such as dye cutting; folding and gluing; injection molding; and stamp forming. The lower rim of front side 18F includes a serrated cutting edge 22. The cutting edge 22 may be formed as an integral part of the material used for the adapter 10 when stiff materials are used, or alternately may be formed of a separate strip of rigid material and affixed to the lower rim of the front side 18F. Shown in phantom lines within the end piece 20L are a number of additional elements which are described in detail below. These include a supply roll of web 14', and a spring element 26.

While the illustrative and alternate embodiments described herein specifically recite the dispensing of household plastic wrap, it is clear that the methods and apparatus of the present invention are equally applicable to the dispensing of a wide range of roll products. Within this range, typical household products would include wax paper, aluminum foil, paper towels, and the like; and typical industrial products would include electrical insulating wrap, impregnated papers/fabrics, and the like. To aid in subsequent drawings and descriptions, a longitudinal axis of the adapter 10 is defined as being parallel to the line containing the serrated cutting edge 22; and a transverse plane is defined as orthogonal to that axis—that is, any plane parallel to either end 20 for 20R.

In FIG. 2, the dispenser adaptor 10 is shown lifted from its associated box 12, and both articles are shown in partially fragmented form to illustrate selected internal components. Within the upper portion of the adapter 10 is a pressure plate 24 which is affixed to a pair of spring elements 26L and 26R via suitable attachment means 28. The dispenser box 12 may be of conventional construction, but is shown advantageously as having a first top portion 30 which is carried by a back side 32B, which in turn is connected to a bottom 34. With brief reference to FIG. 3A, in addition to FIG. 2, a simplified cross sectional view of the box 12 will clarify the remaining box elements. A second top portion 36 is carried by a front side 32F, the two top portions being substantially parallel and including a gap 38 through which the plastic wrap 14, or other web, is passed. The box 12 further has ends 40L and 40R and is typically made of light to medium weight paperboard so that its various surfaces are somewhat flexible.

Figure 3B:
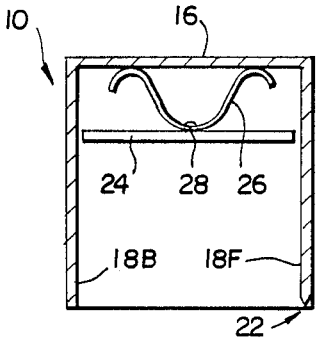
FIG. 3B is a simplified transverse cross sectional view of the improved adapted.
Figure 3C:
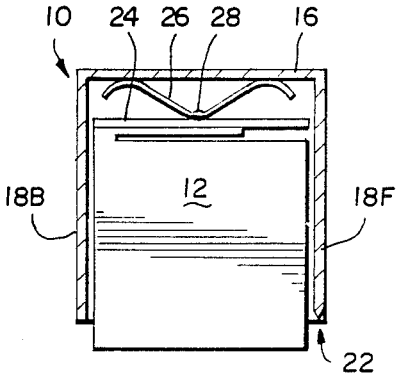
FIG. 3C is a simplified transverse cross sectional view of the improved adapter fitted onto an idealized dispenser box.

A simplified cross sectional view of the adapter 10 is shown in FIG. 3B, and a simplified cross sectional view of the adapter 10 positioned over an idealized box 12 is shown in FIG. 3C. The relative sizes of the various elements throughout the various drawings are, of course, not strictly to scale. Throughout the present description, the letters designating front or back, "F" or "B", and the like, will be omitted from the description of views where this orientation /position information is not needed. In FIG. 3B, the spring 26 is substantially relaxed and the pressure plate 24 assumes a non inserted "at rest" position within the adapter 10. In FIG. 3C, the adapter 10 is positioned over the box 12 such that the pressure plate 24 bears against the top of the idealized box 12 under the urging of the partially compressed spring 26. Typically, the adapter 10 will fit over the box 12 to a depth of about three quarters of the height of sides 32 when in the inserted "at rest" position; and will cover slightly more when the user applies squeezing forces. Note that as the spring 26 is compressed, its outer ends are urged outwards, approaching closer to the front and back sides 18F and 18B. In use, when this pressure plate 24 is caused to bear against the two top portions 30 and 36, that action will tend to close the gap 38 and will tend to brake any movement of the wrap 14. This braking action—shown as generated by the pair of forces F and F' in FIG. 1—may be controlled by the user to produce a proportional effect. Thus, a slight squeezing by the user's fingers applies a light force through the gap 38 which applies a slight frictional loading on the wrap. This loading produces a slight resistance to the pulling action—shown as generated by the pulling force P in FIG. 1—which both brakes the web movement and reduces the rolling action which is imparted to the roll of material 14' remaining in the box 12. So the wrap 14 slows down, and the roll of material 14' comes virtually to a stop under the friction of its own weight.

When the desired amount of wrap 14 has been dispensed, the user simply increases the forces F—F' by squeezing firmer and fully stops the web movement permitting the wrap 14 to be torn off along the serrated edge 22. During this tearing step, the roll of material 14' is fully braked by virtue of the firm squeezing and is effectively decoupled from any external additional pulling force, as well as from any internal recoil forces tending to retract the web end back into the box 12. Also, the location of the cutting edge 22 removes any necessity for finger contact during these steps, resulting in a very safe overall action.

Figure 4A:
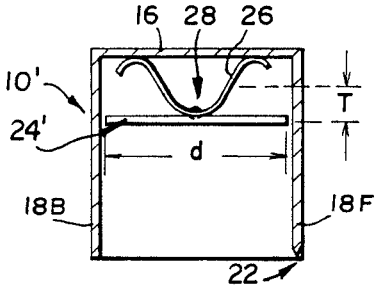
FIGS. 4A and 4B are simplified transverse and longitudinal cross sectional views respectively of a preferred metal spring embodiment used with the improved adapter.
Figure 4B:
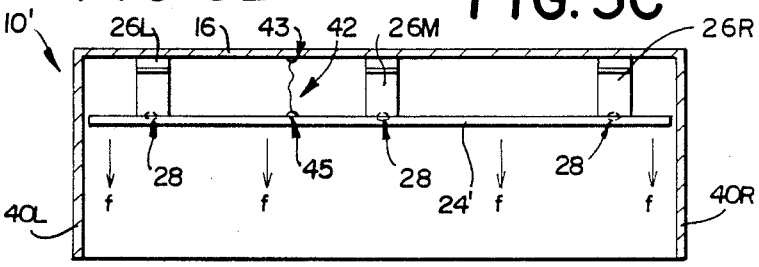

Referring to FIGS. 4A and 4B, there are shown simplified transverse and longitudinal cross sectional views respectively of a preferred spring embodiment used to implement an improved adapter 10'. FIG. 4A depicts an adapter similar to that of FIG. 3B except that the depth "d" of the pressure plate 24' is less than that of the pressure plate 24 of FIG. 3B. While either depth will provide the desired urging action against the top elements of an associated box 12, the narrower dimension of plate 24' may be useful for a wider range of box configurations due to its more centrally restricted pressure area. During use, the pressure plate 24' may experience vertical travel to an extent approximated by the dimension "T".

In the longitudinal view of FIG. 4B there is shown retaining means 42 which may be used to hold the plate 24' attached to the adapter 10'. This retaining means may take a number of forms, such as a simple length of thread or ribbon attached at points 43 and 45, or may in some embodiments be omitted entirely. In either event, the springs 26 are the only significant elements for determining the amount of pressure applied to the top elements of any associated box 12 in response to the user of applied forces F and F'. This is accomplished by suitably controlling the various spring constants such that a very specific amount of pressure is exerted by them; and further by devising the spring structure such that specific amounts of pressure are exerted over a predetermined distance of travel (in compression) "T". These dynamic characteristics are readily achieved by the use of well known spring steel materials, and by well known spring fabrication techniques. Additionally, by suitable selection of the number of springs 26 used, their relative replacement, and the properties of the pressure plate 24', a desired longitudinal distribution of forces "f" may be readily achieved. In addition to left and right springs 26L and 26R, a spring 26M, attached by means attachment 28, is shown as positioned at the middle of the plate 24' to accomplish this desired distribution. Clearly, Other numbers of springs and other spring positions along the length of pressure plate 24' are also contemplated.

Thus far there has been described basic and preferred embodiments of an improved adapter 10 (and 10') which provide new and improved operating modes by virtue of the controllable array of forces "f" which may be exerted to greatly improve the dispensing of webs. These embodiments teach simple structures for exerting the desired magnitudes and spatial distributions of forces along the longitudinal and transverse axes, and for exerting this array of forces for the desired distance of travel. The significance of these new operating modes is that they allow for both proportional and "bang-bang" braking action of the webs being dispensed without dependence of the spring properties (or lack of same, or the aging of same) of the materials actually used to fabricate the outer shells of either the adapter 10 or the box 12. Also significant is that these new operating modes are achieved without requiring any undue amount of manual dexterity by the user.

Figure 5A:
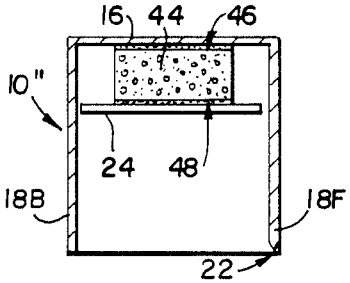
FIGS. 5A and 5B are simplified transverse and longitudinal cross sectional views respectively of an alternate embodiment of the improved adapter employing resilient materials in lieu of the metal spring elements.
Figure 5B:
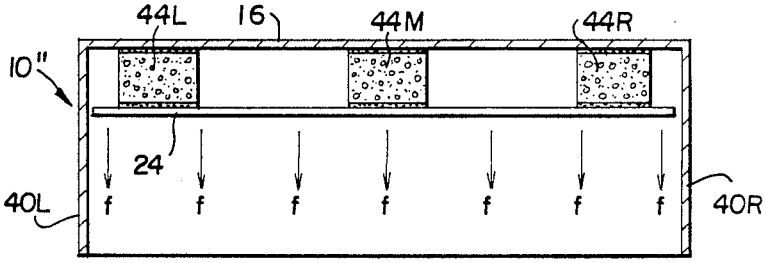

Referring now to FIGS. 5A and 5B, there is shown an alternate embodiment of the improved adapter 10' (designated as 10'') wherein the metal springs 26 have been replaced by resilient material sections 44. Any one of a number of low cost resilient materials in the plastic foam family may be used to provide the above described dynamic spring action. As with FIG. 4B, FIG. 5B shows the use of three elements, including a left resilient member 44L, a middle resilient member 44M, and a right resilient member 44R. The resilient members 44 are attached to the top 16 and pressure plate 24 by layers of adhesive 46 and 48 (as shown best in FIG. 5A), and therefore the retaining means 42 of FIG. 4B is not required. The array of distributed forces "f" produced by the embodiment of adapter 10'' are substantially the same as for the discrete metal spring embodiment previously described.

Figure 6A:
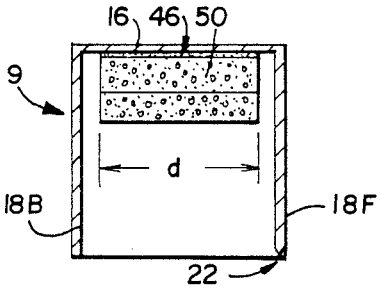
FIGS. 6A and 6B are simplified transverse and longitudinal cross sectional views respectively of a further alternate embodiment of the improved adapter employing resilient materials.
Figure 6B:
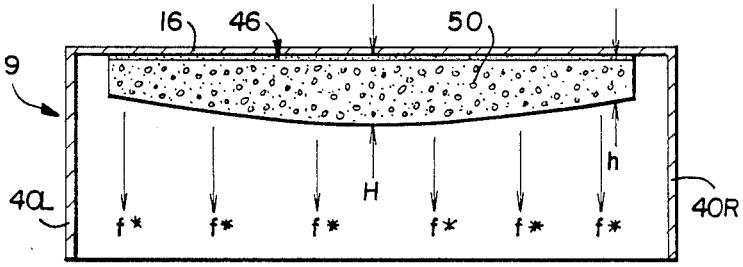

A further alternate embodiment employing resilient materials is shown in FIGS. 6A and 6B wherein the combination of discrete resilient members and a single pressure plate is replaced by a one piece resilient member 50. This embodiment is designated as improved adapter 9 and includes the resilient member 50 having a depth "d", about the same size as that of FIG. 4A, and a longitudinal length (not designated by a symbol), about the same as that of FIG. 4B. The member 50 is affixed to the adapter 9 by a layer of adhesive 46. As distinct from the previous embodiments, the array of distributed forces "f*" produced may be shaped as a result of varying the vertical dimension of the resilient member 50 along its longitudinal length. This is shown as the symmetrical difference in thicknesses indicated by the dimensions "H" greater than "h" in FIG. 6B.

Figure 7A:
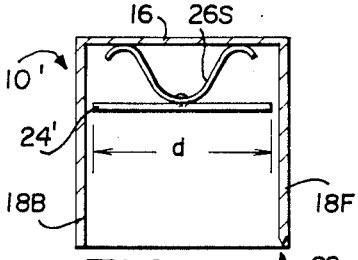
FIGS. 7A and 7B are simplified transverse and longitudinal cross sectional views respectively of the improved adapter employing a single piece spring element.
Figure 7B:
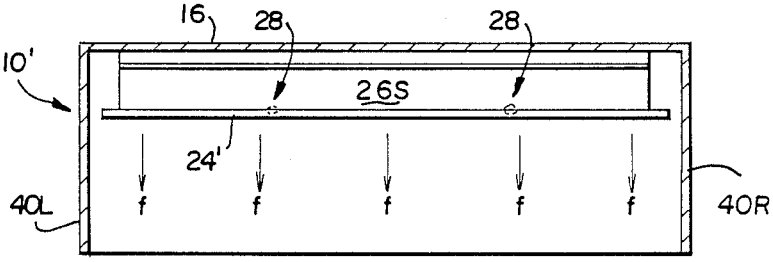

Also contemplated within the range of embodiments according to the present invention is the substitution of the multiple spring 26 by a single piece spring element 26S as shown in FIGS. 7A and 7B. The spring 26S is shown as attached to the pressure plate 24' by attachment means 28 (illustratively, two are shown), and retaining means previously described may or may not be included. As with the previously described embodiments of FIGS. 4A and 4B, the various spring constants of the single spring 26S are suitably chosen to produce the desired array of forces "f" along its longitudinal axis responsive to the user applied forces F—F'.

Although the invention has been described in terms of selected preferred embodiments, the invention should not be deemed limited thereto, since other embodiments and modifications will readily occur to one skilled in the art. One such modification would be the combining of any of the various adapter embodiments described above with a mating dispensing box to form a complete dispensing unit—in lieu of a dispensing adapter. To implement this modification a dispensing box of the type depicted in part in FIG. 3A would be combined with an adapter of the type depicted in part in FIG. 3B. Various kinds of interconnection means may be employed to retain the box and adapter shells together, such as: mating male/female indentations formed into corresponding end sections; interlocking or projecting tabs formed into corresponding sides; or adhesively attached retaining means of the general type described in connection with the embodiment of FIG. 4B. It is therefore to be understood that the appended claims are intended to cover all such modifications as fall within the true spirit and scope of the invention.

What is claimed is:

1. A dispensing aid for improving the dispensing of thin webs from rolls carried in elongated containers having a top formed of two substantially parallel surfaces, said dispensing aid comprising:

(a) a cover having an elongated top member affixed to front and back members, all joined by a pair of side members to form an open bottomed covering device for fitting over said container;

(b) at least one spring affixed to the underside of said top member;

(c) a pressure applying surface on said spring for applying a distributed array of forces to the top of said container responsive to externally applied force; and (d) whereby the web being routed through said two parallel surfaces for removal from said roll may be controlled responsive to said distributed forces.

2. The dispensing aid of claim 1 wherein said pressure applying surface is a pressure plate affixed to said spring and said spring comprises at least two springs affixed at distributed positions along said pressure plate.

3. The dispensing aid of claim 2 further comprising a cutting element formed along a lower edge of said cover front member for cutting said controllably removed web.

4. The dispensing aid of claim 1 wherein said at least one spring comprises a volume of resilient material.

5. The dispensing aid of claim 4 wherein said spring comprises at least two springs affixed at distributed positions along the underside of said top member.

6. The dispensing aid of claim 5 further comprising a cutting element formed along a lower edge of said cover front member for cutting said controllably removed web portion.

7. A dispenser unit for improved dispensing of thin webs from rolls carried in containers, comprising:

(a) an elongated rectangular container for carrying a roll of thin web material, said container having a top formed of two substantially parallel surfaces through which said web is routed;

(b) a cover having an elongated top member affixed to front and back members, all joined by a pair of side members to form an open bottomed covering device for attachably fitting over said container;

(c) at least one spring comprising a volume of resilient material having controlled dynamic properties affixed to an interior surface of said top member;

(d) a pressure applying surface on said spring for applying a distributed array of forces to the top of said container;

(e) whereby a portion of the web being removed from said roll may be controlled responsive to said forces.

8. The dispenser of claim 7 wherein said pressure applying surface is a pressure plate affixed to said spring.

9. The dispenser of claim 8 wherein said spring comprises at least two springs affixed at distributed positions along said pressure plate.

10. The dispenser of claim 9 further comprising a cutting element formed along a lower edge of said cover front member for cutting said controllably removed web portion.

11. The dispenser of claim 7 wherein said resilient material comprises a volume of elastomeric material.

12. The dispenser of claim 11 further comprising a pressure plate affixed to said elastomeric material spring.

13. The dispenser of claim 11 wherein said elastomeric material spring comprises at least two spring portions affixed at distributed positions along said pressure plate.

14. The dispenser of claim 13 further comprising a cutting element formed along a lower edge of said cover front member for cutting said controllably removed web portion.

* * * * *